United States Patent [19]

Nordine

[11] Patent Number: 4,497,262

[45] Date of Patent: Feb. 5, 1985

[54] WOOD FIRED BOILER

[76] Inventor: Clifford Nordine, Roosevelt, Minn. 56673

[21] Appl. No.: 548,284

[22] Filed: Nov. 3, 1983

[51] Int. Cl.[3] ..... F23B 7/00

[52] U.S. Cl. ..... 110/234; 122/6 A; 122/15; 122/19; 126/132

[58] Field of Search ..... 122/6 A, 15, 19, 511; 110/234; 126/132

[56] References Cited

U.S. PATENT DOCUMENTS

| | | | |
|---|---|---|---|
| 614,206 | 11/1898 | Hutchison | 122/6 A |
| 1,593,984 | 7/1926 | Murray | 122/6 A |
| 4,226,195 | 10/1980 | Lindroos | 110/234 |
| 4,413,590 | 11/1983 | Landreau | 122/15 X |

*Primary Examiner*—Edward G. Favors

*Attorney, Agent, or Firm*—Merchant, Gould, Smith, Edell, Welter & Schmidt

[57] ABSTRACT

A wood-fired boiler construction is shown having a firebox (15) mounted on a metal base (12) and concrete slab (11) in an insulated shed (13). The firebox is a generally box-like structure constructed from spaced, metal tubular members (16) of generally rectangular cross section, the tubular members each having the wider cross-sectional dimension thereof in the plane of a respective wall. The tubular members are interconnected to provide a free flow of fluid throughout the walls of the box-like structure, and spaces between the tubular members are covered by metal plates overlying and connected to the outer sides of the walls. A fluid storage tank (30) is mounted above the firebox and is interconnected to the firebox to provide a flow of fluid therebetween. The firebox is provided with a door and a chimney, both having dampers therein to control combustion.

7 Claims, 4 Drawing Figures

FIG. 2
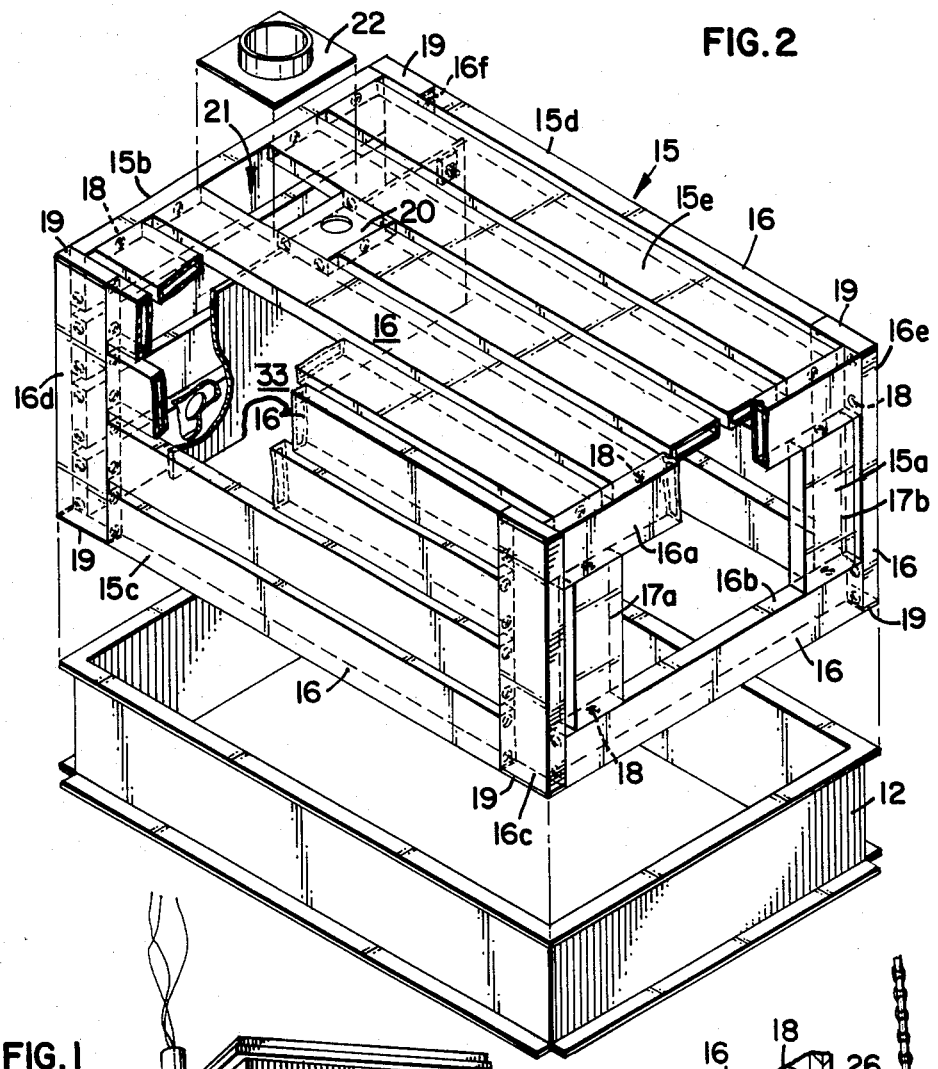
FIG. 1
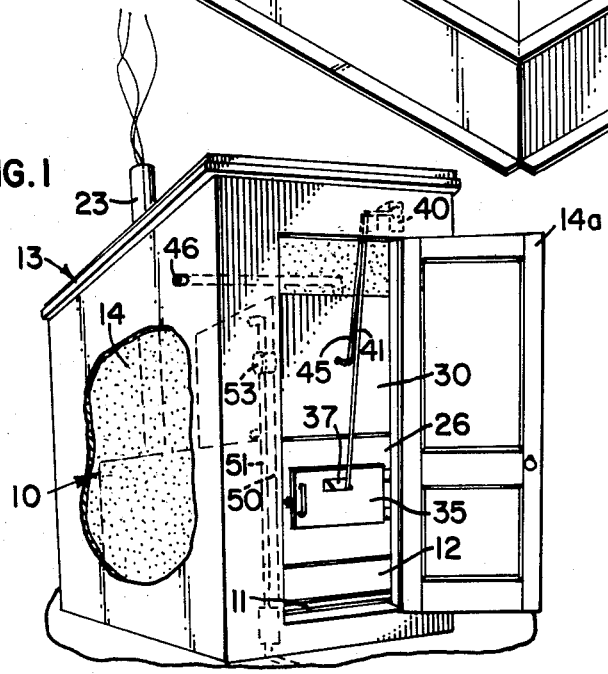
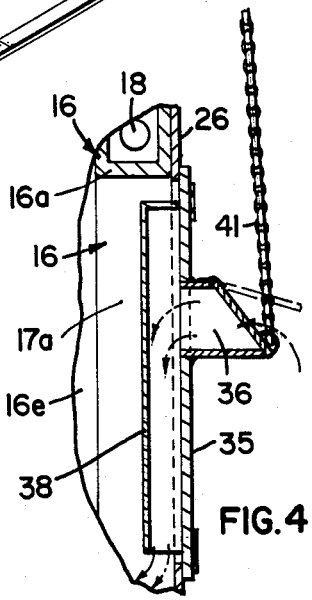
FIG. 4

WOOD FIRED BOILER

BACKGROUND OF THE INVENTION

Because of the energy crisis, considerable effort has been expended in recent years to develop improved heating systems for homes and small businesses, and particularly those heating systems which use readily available fuels such as wood. One development has been the use of wood fired boilers which are located outside of the building being heated. Typically, a wood fired furnace or boiler is situated in a small building a distance from the home or business being heated and the heat is then piped underground to the building. This reduces the risk of fire and also reduces the amount of dirt and trash being introduced into the house or business with the wood being burned. Although furnaces and boilers which have been developed for use within the building being heated can be used in this application, there has developed a need for a rugged, easily constructed, relatively inexpensive wood fired boiler which will extract as much heat as possible from the wood being burned and store that heat until it is used.

SUMMARY OF THE INVENTION

The present invention provides a wood fired boiler which can be constructed from readily available structural steel. The firebox itself is constructed from rectangular steel tubes which can easily be cut to the correct lengths and welded together to form a box-like structure. The end, side and top walls are all constructed from the rectangular steel tubes each having a wider cross sectional dimension thereof lying in the plane of the respective wall. The tubular members are spaced about one inch apart to provide room for fabrication and to create a greater surface area for engagement by the fire inside the firebox, and the spaces between the tubular members are covered by metal plates which overlie and are welded to the outsides of the walls. A water storage tank, also constructed from metal plates, is mounted on the top wall and pipes are connected between the storage tank and the firebox to provide a free flow of fluid therebetween. The result is a highly efficient boiler construction which can be readily constructed from easily available materials and which is sufficiently rugged to withstand the strains imposed on a heating unit of this nature. In application, the unit is mounted on a rectangular base constructed from steel channel irons welded together at the ends, and the entire unit is mounted on a concrete slab. A suitable housing or shed is then built around the unit and the space between the heating unit and the shed is filled with nonflammable insulation. The fluid or water in the storage tank is piped underground into the building or buildings to be heated. Suitable damper controls are provided to regulate the combustion within the unit. The unit is especially effective at minimizing the number of areas where creosote can build up, and particularly effective at preventing creosote buildup in the chimney, making cleaning of the unit and chimney all but unnecessary.

BRIEF DESCRIPTION OF THE DRAWINGS

FIG. 1 is a view in perspective of a boiler construction according to the present invention, mounted within a remotely located housing unit, portions thereof being broken away and portions being shown in phantom;

FIG. 2 is an enlarged view in perspective of the firebox and base construction, portions thereof being broken away;

FIG. 4 is an enlarged cross-sectional view of the door construction, taken along line 4—4 of FIG. 3.

DETAILED DESCRIPTION

Figure 3:
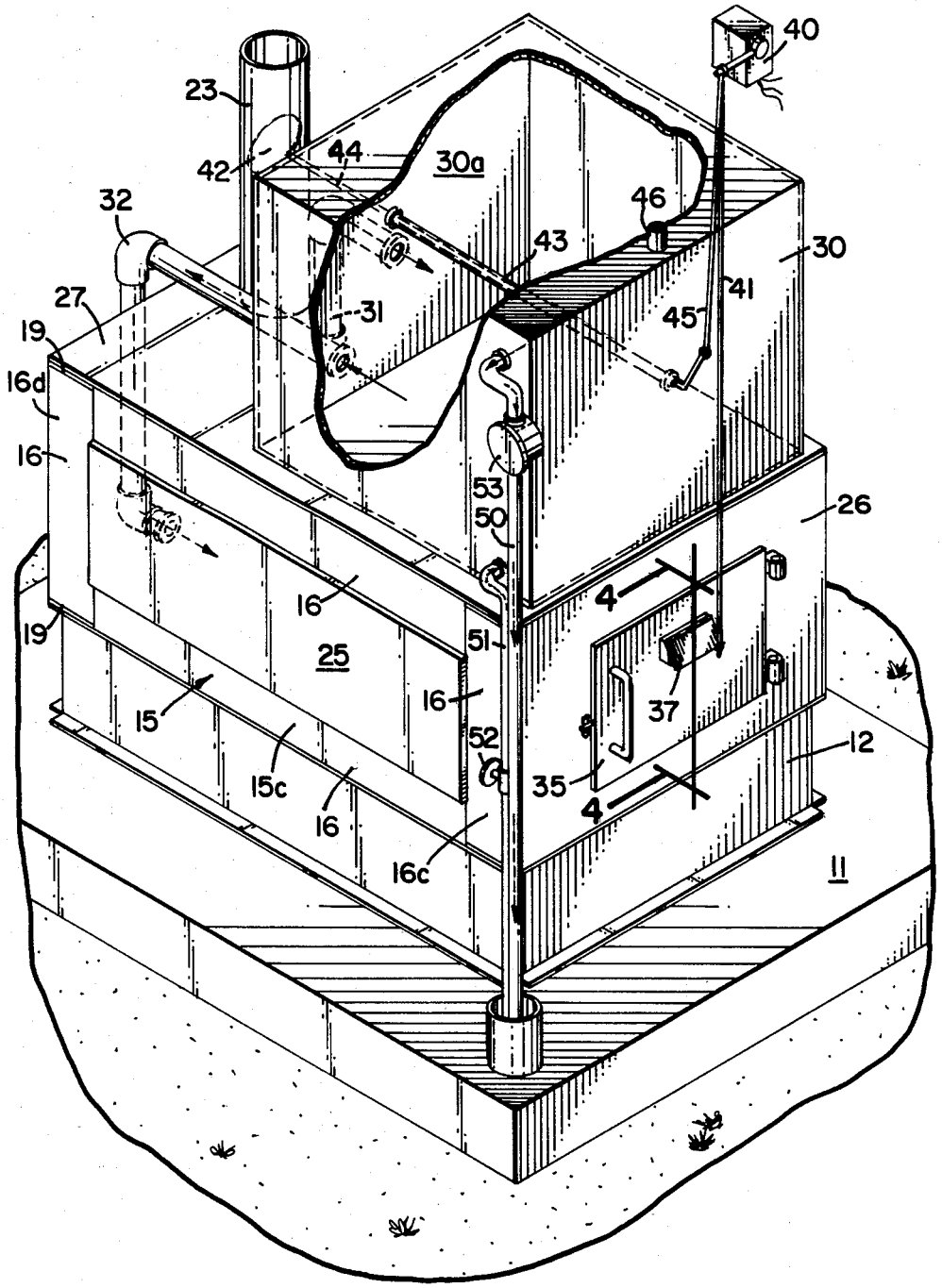
FIG. 3 is a view in perspective of the complete boiler construction, portions thereof being broken away.

Referring now to the drawings, wherein like elements of the invention are identified by the same numerals throughout the several views, there is disclosed in FIG. 1 a wood-fired boiler unit 10 mounted on a base including a concrete slab 11 and a rectangular metal unit 12 positioned on slab 11. The boiler unit 10 is mounted within a small building or shed 13 and the space between them is filled with a non-flammable insulating material 14 such as fiberglass batts. Shed 13 is provided with a door 14*a* to give access to the front of boiler unit 10.

The boiler unit 10 comprises a firebox 15 mounted on the metal base unit 12. Firebox 15 is a generally rectangular, box-like structure having planar front and rear ends 15*a*, 15*b*, opposite sides 15*c*, 15*d*, and a top wall 15*e*. The walls are constructed from spaced, metal tubular members 16 of generally rectangular cross section. The tubular members 16 have square ends and are simply cut from tubular steel stock having a wall thickness of approximately 3/16 inch. In the preferred embodiment, the tubular members 16 have inner and outer sides approximately six inches in width, opposite edges approximately two inches in width and opposite open ends.

The tubular members 16 include a plurality of header members (or manifolds) and a plurality of wall-forming members interconnected to provide a free flow of fluid throughout the walls of the box-like structure. In particular, the front wall 15*a* comprises upper and lower, horizontally extending, parallel header members 16*a*, 16*b*. Side wall 15*c* comprises vertically extending header members 16*c*, 16*d* at opposite ends thereof, and side wall 15*d* includes vertically extending header members 16*e*, 16*f* at opposite ends thereof.

Front end wall 15*a* further comprises a plurality of vertical, tubular wall forming members 17*a*, 17*b* extending between the upper and lower header members 16*a*, 16*b* near the opposite ends thereof to form a door opening therebetween. Holes such as hole 18 are cut or drilled in an edge of header members 16*a*, 16*b* in line with the open ends of wall forming members 17*a*, 17*b*, and the ends are then welded to the edges so that all four tubular members 16 forming front end wall 15*a* are interconnected for the free flow of water or other heating fluid therethrough.

The two vertical headers 16*c*, 16*d* of side wall 15*c* are interconnected at their respective inner edges by a plurality of horizontally extending, spaced tubular wall forming members 16. The ends of wall forming members 16 are welded to the edges of header members 16*c*, 16*d* and in each case a pair of spaced holes 18 are formed in the edges to provide a free flow of cooling fluid through wall 15*c*. Side wall 15*d* is constructed in exactly the same manner.

Rear end wall 15*b* has upper and lower horizontally extending header members or wall forming members and another pair of horizontally extending wall forming members between them, all of which are interconnected at their ends to header members 16*d*, 16*f* by means of holes 18 in the sides thereof. The top and bottom ends of the four vertical header members are covered and closed by means of plugs or caps 19 welded thereto.

Top wall 15*e* comprises a plurality of horizontally extending tubular wall forming members 16 welded at their opposite ends to the upper, horizontally extending header members in the end walls 15*a*, 15*b*, which again are provided with openings in their sides in line with the open ends of the tubular members 16. In the preferred embodiment, the center wall-forming member 16 in the top wall 15*e* is shorter than the two adjoining wall-forming members and is interconnected at one end thereof to edges of the adjoining wall forming members by means of a cross header 20 welded thereto. The cross header member 20 is welded at its opposite ends to the edges of the adjoining wall-forming members and is welded at its edge to the end of the shorter wall forming member. Holes 18 are again provided to provide a free flow of water therethrough. The short header member 20 is positioned near the rear end wall 15*b* to thereby provide a smoke discharge opening 21 between it and the upper header member of wall 15*b*. A square plate 22 is connected over the opening 21, with the plate 22 having a centrally located circular opening and a short, tubular smoke discharge member extending upwardly therefrom. The chimney 23 shown in the other drawings mounts inside the short tubular member.

In the preferred embodiment, the tubular members 16 are spaced approximately one inch apart wherever possible so that the edges of the tubular members as well as the inner sides thereof are exposed to combustion within the firebox 15. This spacing provides room for fabrication and substantially increases the surface area available for heat transfer purposes.

To prevent the passage of air or combustion products through the openings between the tubular members 16, a plurality of metal plates such as 25, 26 and 27 are welded to the outer surfaces of the top, end and side walls of the firebox 15. The metal plates are placed directly against the flat outer sides of the tubular members forming the walls and are preferably welded thereto. The metal plates 25, 26, 27, etc. not only function to cover the openings between the tubular members, but also provide heat transfer from the combustion chamber by conducting heat to the outer sides of the tubular members 16.

Mounted directly on the top metal plate 27 is a fluid storage tank 30, which is simply a rectangular metal tank formed from flat rectangular metal panels welded together along their respective edges. Although it is preferable to place tank 30 directly on plate 27 to provide additional heat transfer, it would be possible to separate tank 30 from firebox 15 so long as it is placed in a location that would permit thermal cycling to occur. A first conduit member 31 is connected between an opening in a rear wall 30*a* of tank 30 and an opening in the top side of short header member 20. A second conduit member 32 is connected between an opening near the bottom edge of rear wall 30*a* of tank 30 and an opening in the lowermost header member or wall forming member 16 of rear end wall 15*b*.

Firebox 15 is mounted on rectangular support structure 12, which has opposite ends and opposite sides cut from a metal channel iron and welded together at their respective ends. One set of flanges of the I-beam structure then rests on the concrete slab 11 and the upper set of flanges provides support for the firebox 15 which has the same general dimensions. The open interior of firebox 15 is then aligned with the open interior of rectangular support structure 12 to thereby increase the size of the combustion chamber and provide an ash pit within the support structure 12.

Mounted within the firebox 15 about one foot from rear end wall 15*b* is a generally rectangular metal baffle 33 which extends vertically downwardly from the top wall 15*e* and extends between the two side walls 15*c*, 15*d* adjacent the smoke discharge opening 21 on the side opposite the end wall 15*b* to provide a barrier to the direct flow of combustion products from the combustion chamber to the smoke discharge opening 21. The vertical baffle 33 is preferably bolted to tabs welded to the inner sides of the tubular members forming the top wall of firebox 15 and extends down slightly over one-half of the distance from the top to the bottom of the firebox. The baffle 33 holds combustible material within the combustion chamber for a longer period of time, resulting in more complete combustion and less smoke.

As noted earlier, a door opening is provided in the metal plate 26 and front end wall 15*a* of firebox 15 through which combustible material is introduced into the combustion chamber. A metal door 35 for that opening is mounted to the metal plate 26 by means of a pair of hinges. Door 35 is provided with an opening 36 located generally above the center thereof, to the edges of which is welded an outwardly extending tubular member having a downwardly sloping open end which is covered by a hinged damper 37. Damper 37 can be opened and closed to control the flow of air to the fire. Mounted on the inside surface of door 35 is a baffle 38 which is connected to and separated from the door at the upper and side edges by flanges about one inch wide. The space between the door and the bottom of the baffle 38 is open so that air entering the opening 36 is forced downwardly by the baffle 38 to be discharged near the bottom of the fire. This increases the efficiency of the combustion process and enhances the flow of smoke and combustion products through the unit. The flow of cold air through the space between baffle 38 and door 35 acts to cool the door 35 to prevent heat buildup on the door 14*a* of the shed.

The overall outside dimensions of firebox 15 are 60 inches long, 40 inches wide and 27 inches high. The shed 13 is seven feet long and five feet wide. The inside dimensions of the firebox are 56 inches long, 36 inches wide and 25 inches high. The water tank 30 is 36 inches long, 36 inches wide and 30 inches high. Although these dimensions are not critical, they are illustrative of a workable embodiment.

A damper motor 40 is mounted in shed 13 above door 14*a* and is connected to damper 37 by means of a chain 41. A damper 42 is also provided in stack 23. The front and rear walls of tank 30 have small openings therein which are connected by a tubular member 43 in the nature of a pipe welded at its opposite ends to the openings. Extending through the pipe 43 is a damper control rod 44 connected to the damper 42, the rod 43 having a 90 degree extension at its front end which is connected to the damper motor 40 by means of a chain 45. Although not shown, damper motor 40 would be thermostatically controlled to maintain the temperature of the water in tank 30 at a selected level. When additional heat is needed, the motor 40 is energized to lift the chains 41, 45 to open both the damper 37 and damper 42. When the temperature rises sufficiently, the motor 40 is energized to rotate its arm in the opposite direction permit closing of the two dampers.

It should also be noted that tank 30 is vented to atmosphere by means of a pipe 46, one end of which is connected to an opening in the top of tank 30 and the other end of which extends through the wall of shed 13. This maintains the pressure of the fluid in the tank at atmospheric pressure.

To provide a means of transferring the heated water to a building to be heated, an outlet pipe 50 is connected to a side wall of tank 30 near the top thereof and an inlet pipe 51, having a shutoff valve 52 therein, is connected to a sidewall of tank 30 near the bottom thereof. Outlet pipe 50 has an electrically operated pump 53 therein which can be run continuously or can be operated intermittently by means of a thermostat located in the building or buildings to be heated. Pipes 50 and 51 both extend downwardly through a tubular pipe extending through slab 11 and downwardly into the ground to a suitable depth.

In operation, wood is inserted through door 35 and the fire is started. An ash or sand buildup is provided within the base unit 12 to insulate the slab 11 and to permit the heating unit to be used for a period of time without cleaning out the ashes being accumulated. The fire within the combustion chamber impinges upon the tubular members 16 including both their inside side walls and their edges. Further, heat is transferred to the outsides of the tubular members 16 by means of the metal plates 25, 26 and 27. Both the tank 30 and the firebox 15 are filled with water or other suitable mixture of fluid such as a water-antifreeze mixture. As the fluid is heated, it expands such that the heated water is lighter or less dense than the cooler water. The water or fluid thus circulates by gravity with the heated fluid rising upwardly in the firebox and exiting through conduit 31 into the top of tank 30, with the cooler water then flowing downwardly through conduit 32 into the lower regions of firebox 15. A thermal siphon is thus established which creates a continuous flow to move the heated water into the tank 30 and move the cooled water returning from the building being heated into the firebox to be reheated. I believe that the boiler unit is very efficient at capturing the heat being generated by the wood fire and storing that heat within the insulated shed to be available to circulate within the building or buildings being heated. So long as a fire is maintained, the unit will provide a constant supply of hot water, even at extremely cold outside temperatures.

What is claimed is:

1. A boiler construction, comprising:

(a) a base;

(b) a firebox mounted on said base, said firebox being a generally box-like structure having planar ends, sides and top walls, said walls having door and smoke discharge openings therein, said walls being constructed from spaced, metal tubular members of generally rectangular cross section, said tubular members each having a wider cross sectional dimension thereof coplanar with said respective wall, said tubular members including a plurality of header members and a plurality of wall forming members interconnected to provide a free flow of fluid throughout the walls of said box-like structure, and said structure further having metal plates overlying and connected to said walls to cover said spaces between said tubular members;

(c) a fluid storage tank mounted above said top wall;

(d) means interconnecting said box-like structure and said tank to provide a flow of fluid therebetween; and (e) said door is located in a front end wall of said firebox and said smoke discharge opening is located in said top wall adjacent a rear end wall of said firebox, said smoke discharge opening having a smoke stack extending upwardly therefrom with a movable damper therein, wherein said fluid storage tank is mounted on said plate covering said top wall and has a front wall adjacent said door and a rear wall adjacent said stack, said front and rear walls having openings connected by a tubular member, and a damper control rod extending through said tubular member connected to said damper whereby said damper can be controlled from the front of said boiler construction.

2. A boiler construction according to claim 1 wherein said end walls comprise upper and lower horizontally extending header members, and said side walls comprise vertically extending header members at opposite ends thereof welded to said upper and lower header members of said end walls, said wall forming members being welded at opposite ends to said header members, said header members having open ends, and means for closing the open ends of header members not intersecting other tubular members.

3. A boiler construction according to claim 2 wherein said tubular members have inner and outer sides, opposite edges, and opposite open ends, wherein said open ends are welded to either a side or edge of said interconnecting tubular member, and openings are formed in said sides or edges in line with said open ends to provide said free flow of fluid therethrough.

4. A boiler constructed according to claim 2 wherein said tubular members forming said walls are spaced apart, and wherein one of said wall-forming members in said top wall is shorter than the two adjoining wall forming members and is interconnected at one end thereof to edges of said adjoining wall-forming members by means of a cross header welded thereto, to thereby provide said smoke discharge opening between said cross header and said adjoining upper end wall header member.

5. A boiler constructed according to claim 1 wherein said last-named means comprises a first pipe connecting a bottom portion of said tank to a lowermost one of said tubular members, and a second pipe connecting said tank to a wall-forming member in said top wall of said firebox.

6. Heating apparatus, comprising:

(a) a base;

(b) a firebox mounted on said base, having planar ends, sides and top walls, said walls having door and smoke discharge openings therein, said walls being constructed from spaced, metal tubular members of generally rectangular cross section, said tubular members having inner and outer sides, opposite edges, and opposite open ends, said tubular members forming said walls having said inner and outer sides thereof coplanar with said respective walls;

(c) said tubular members including a plurality of header members and a plurality of wall forming members interconnected to provide a free flow of fluid throughout the walls of said firebox, said tubular members forming said walls being spaced apart a short distance to provide additional heat transferring surface to said firebox;

(d) means covering said spaces between said tubular members to prevent passage of air or combustion products therethrough comprising a plurality of metal plates overlying and connected to said outer sides of said walls;

(e) a fluid storage tank mounted above said top wall; and (f) conduit means interconnecting said box-like structure and said tank to permit a flow of fluid therebetween.

7. Heating apparatus according to claim 6 wherein said door is located in a front end of said firebox and is provided with an opening having a movable damper therein to control the flow of air entering said combustion chamber, and wherein a baffle is mounted on said door spaced from and covering a rear surface thereof and having an air discharge opening along a bottom edge thereof so that air is discharged into said chamber at a bottom edge of said door.

* * * * *